US009540169B1

(12) United States Patent
Krohn

(10) Patent No.: US 9,540,169 B1
(45) Date of Patent: Jan. 10, 2017

(54) SUBSEA STORAGE TANK FOR BULK STORAGE OF FLUIDS SUBSEA

(71) Applicant: Daniel A. Krohn, Houston, TX (US)

(72) Inventor: Daniel A. Krohn, Houston, TX (US)

( * ) Notice: Subject to any disclaimer, the term of this patent is extended or adjusted under 35 U.S.C. 154(b) by 0 days.

(21) Appl. No.: 14/993,994

(22) Filed: Jan. 12, 2016

Related U.S. Application Data

(60) Provisional application No. 62/102,743, filed on Jan. 13, 2015.

(51) Int. Cl.
*B65D 88/78* (2006.01)

(52) U.S. Cl.
CPC ..... *B65D 88/78* (2013.01)

(58) Field of Classification Search
CPC ..... B65D 88/78
See application file for complete search history.

(56) References Cited

U.S. PATENT DOCUMENTS 2,696,185 A * 12/1954 Snoddy ..... B63B 25/08 114/74 R
3,385,477 A * 5/1968 Chevalaz ..... B65D 88/62 222/136
3,508,686 A * 4/1970 Goldberg ..... B65D 88/62 222/135
3,518,836 A * 7/1970 Itokawa ..... B65D 88/78 405/210
3,630,161 A * 12/1971 Georgii ..... B65D 88/78 114/256
3,727,418 A * 4/1973 Glazier ..... F17C 3/005 114/257
3,749,165 A * 7/1973 Heaton ..... E21B 33/03 138/30
3,824,942 A * 7/1974 Stafford ..... B65D 88/78 405/210
3,837,310 A * 9/1974 Toyama ..... B65D 88/78 114/257
3,943,724 A * 3/1976 Banzoli ..... B65D 88/78 114/257
4,007,700 A * 2/1977 Haynes ..... B63B 35/28 114/74 T
4,141,377 A * 2/1979 Fernandez ..... B65D 88/62 137/236.1
4,178,868 A * 12/1979 Iizuka ..... B63B 25/08 114/74 R (Continued)

FOREIGN PATENT DOCUMENTS

CH 590768 A5 * 8/1977 ..... B65D 88/62
FR 2272916 A2 * 12/1975 ..... B60K 15/03

*Primary Examiner* — Frederick L Lagman
(74) *Attorney, Agent, or Firm* — John Timothy Headley

(57) ABSTRACT

A subsea storage tank for the storage of bulk fluids is adapted for being set on the sea floor, and is adapted for supplying to local subsea oil and gas production facilities a wide variety of production support fluids. The subsea storage tank includes an inner and outer shell, the shells being adapted so that a barrier fluid can be inserted into and between the shells. An interior barrier separates the interior stored fluid from sea water that is free to enter into the tank, on the opposite side of the barrier, to compensate to the varying volume of stored fluid. An identical tandem barrier is formed nearly identical to the first barrier, and is formed and positioned so that the two barriers act together, and so that the space between them can contain fluid as well, and acts like a bladder.

4 Claims, 3 Drawing Sheets

(56) References Cited

U.S. PATENT DOCUMENTS

| | | | | |
|---|---|---|---|---|
| 4,190,072 | A * | 2/1980 | Fernandez | B65D 88/62 137/236.1 |
| 4,662,386 | A * | 5/1987 | Pedersen | B65D 88/78 137/236.1 |
| 4,777,982 | A * | 10/1988 | Borowitz | F15B 1/10 138/30 |
| 5,027,860 | A * | 7/1991 | Tuthill, Jr. | B65D 88/62 138/26 |
| 7,424,917 | B2 | 9/2008 | Martin | |
| 2008/0210434 | A1 | 9/2008 | Edwards | |
| 2012/0260839 | A1* | 10/2012 | Maher | B65D 90/02 114/257 |
| 2013/0167962 | A1 | 7/2013 | Skjetne et al. | |
| 2014/0301790 | A1* | 10/2014 | Chitwood | B63B 25/12 405/210 |
| 2014/0341657 | A1* | 11/2014 | Chitwood | B65D 27/08 405/205 |
| 2015/0246770 | A1 | 9/2015 | Chang et al. | |

* cited by examiner

SUBSEA STORAGE TANK FOR BULK STORAGE OF FLUIDS SUBSEA

CROSS-REFERENCE TO RELATED APPLICATIONS

This patent application claims the benefit of provisional patent application Ser. No. 62/102,743, filed Jan. 13, 2015.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION (1) Field of the Invention

The invention relates to a tank for the storage of fluids and chemicals subsea.

(2) Description of Related Art

Tanks that are placed subsea must have certain features to ensure their survivability in the environment. They must contain the working fluids, be compensated to the outside environment and related hydrostatic pressure, and remain intact and in service for the length of their intended mission.

U.S. Pat. No. 7,424,917, which is incorporated herein by this reference, discloses a subsea pressure compensation system which includes a chamber with a piston therein acted on an exposed side by sea water, to provide operational hydraulic fluid for operating a subsea device, with a piston rod having an end in a separate chamber acted on by a fluid to compensate for a pressure differential between the pressure of the water on one piston side and the pressure of the operational hydraulic fluid on the other piston side. However, this reference does not teach, nor suggest, using any of the compensator system or system of pumps to act upon the compensator itself as a self-contained method to test or measure the integrity of the compensator itself, or of any of the barriers that separate the internal fluid from the surrounding outside fluid.

U.S. patent application No. 20080210434A1, which is incorporated herein by this reference, discloses a subsea and modular tanker-based hydrocarbon production system comprising a plurality of interlinked individual tank units which is wholly submersible. However, this reference does not teach, nor suggest, utilizing a pump to generate either a fluid pressure or vacuum to measure the integrity of the walls of the tank.

U.S. patent application No. 20130167962A1, which is incorporated herein by this reference, describes a pressure compensator for a subsea device that embodies the ability of the subsea tank to remain pressure compensated. However, this reference does not teach, nor suggest, using the fluid that is contained between the walls of the compensator to be used in a test protocol to assure the integrity of the wall, or barrier, of the compensator or vessel.

U.S. patent application No. 20150246770A1, which is incorporated herein by this reference, discloses a subsea storage tank, including a body having a storage space therein and formed of light weight concrete inner and outer sides of which are watertight coated or plated. However, this reference does not teach or suggest provisions that allow for the pressurization or vacuum of fluid between the tank inner and outer sides, nor could the fluid in this location be used to test the integrity of either wall of the storage tank or the integrity of the seals of the separation unit.

In light of the foregoing, a need remains for a modular subsea tanker hydrocarbon system, having a dual wall tank, and a barrier bladder, and utilizing a pump to generate either a fluid pressure or vacuum to measure the integrity of both the walls of the tank, and the barrier bladder, to sea water or working fluid.

BRIEF SUMMARY OF THE INVENTION

A subsea storage tank for the storage of bulk fluids, adapted for being set on the sea floor and adapted for supplying to local subsea oil and gas production facilities a wide variety of production support fluids. The subsea storage tank includes an inner and outer shell. The shells are adapted so that fluid can be inserted between the shells. The tank is split into two nearly identical halves, each half having a flange to bolt and assemble the halves into a complete tank. Into and between the flanged halves of the tank, a barrier that also is sealed like a bladder is placed to isolate and prevent comingling of a storage fluid in one half of the tank from the other half. An interior volume is dedicated to the storage of bulk fluids. An interior barrier separates the interior stored fluid from sea water that is free to enter into the opposite side of the barrier to compensate to the varying volume of stored fluid. An identical tandem barrier is formed nearly identical to the first barrier, and is formed and positioned so that the two barriers act together, and so that the space between them can contain fluid as well, and acts like a bladder. A light film of mineral oil or other fluid is between these two barriers so that they are free to slide against each other. The tank includes a pressure or vacuum pump and associated automatic valves so that the shell, and the barrier bladder, can be pressurized or vacuum drawn down to test the integrity of either the shell or the barrier bladder. This testing can be performed at any time, either locally or remotely, either on the surface above the water, or in service subsea, and whether or not the tank contains any amount of bulk fluid. The tank is adapted for lowering subsea either full or empty of bulk fluid, and is adapted for fitting to a temporary or permanent subsea structure, by hoses, pipes, or hydraulic couplings.

BRIEF DESCRIPTION OF THE SEVERAL VIEWS OF THE DRAWINGS

The novel features, characteristic of the invention, are set forth in the appended claims. However, the invention itself, as well as a preferred mode of use, and further objectives and advantages thereof, will best be understood by reference to the following detailed description, when read in conjunction with the accompanying drawings in which the left-most significant digit in the reference numerals denotes the first figure in which the respective reference numerals appear.

DETAILED DESCRIPTION OF THE INVENTION

Figure 1A:
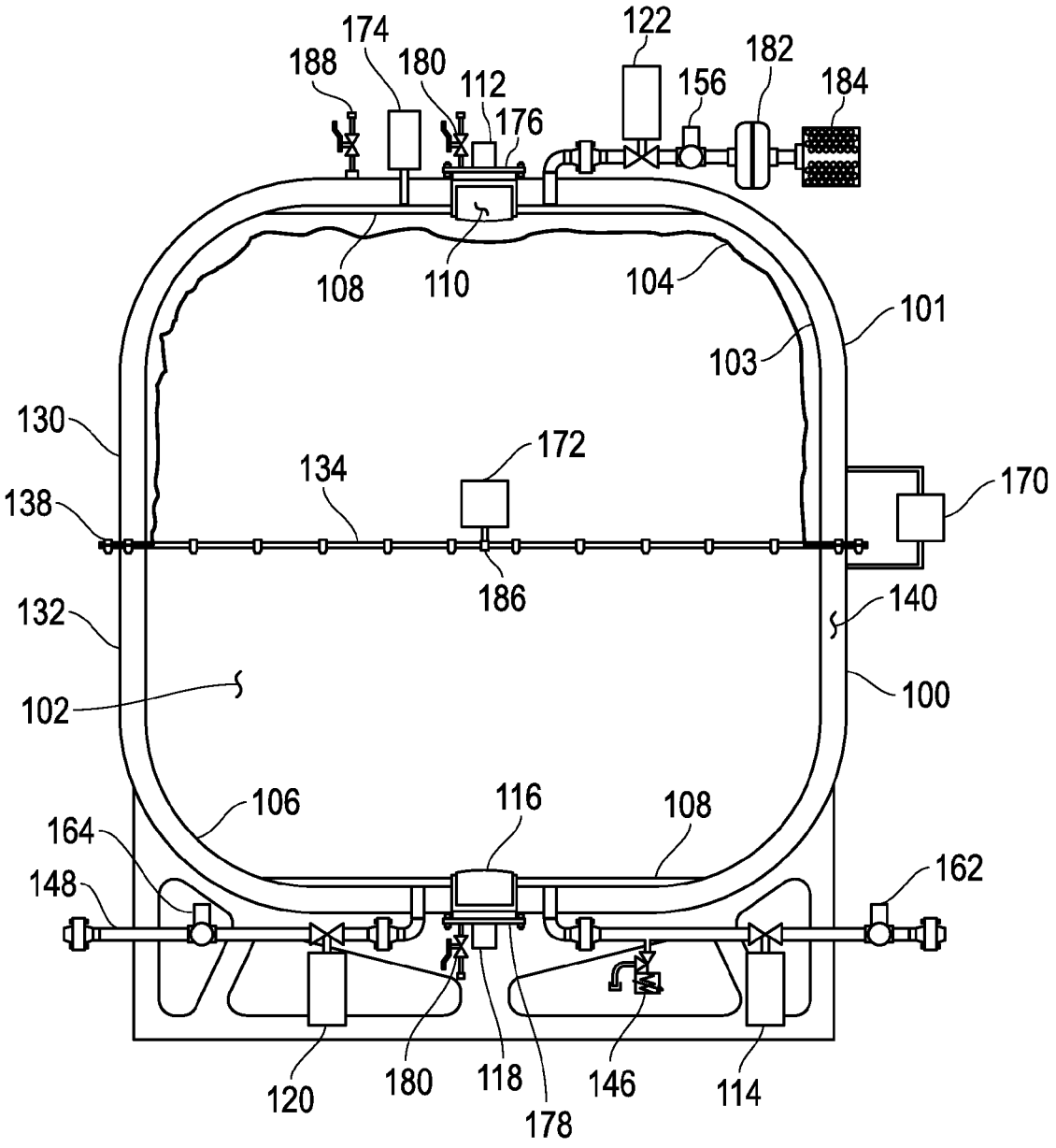
FIG. 1A is a cross-section view of a tank with schematic representations of the tank's dual shells, dual barrier bladder, fluid connections, sump pans, test pumps, valves, and associated instruments.

Referring to FIG. 1A, a storage tank 100 is full of bulk fluid 102 such that a dual barrier bladder 104 is pushed against an inner tank shell 103 and two sump pans 108. This full position actuates a first large diameter piston 110, applying force to a tank full limit switch 112, which generates a signal to stop filling the tank 100. When stop filling is indicated, a fill valve 114 closes. A second large diameter piston 116 and a tank empty limit switch 118 are located at the bottom of the tank 100 such that when the tank 100 is emptied, the dual barrier bladder 104 applies a force against the second large diameter piston 116, which in kind, applies a force against the limit switch 118, sending a control signal to shut a discharge valve 120. During either fill or discharge operation, a sea water compensation valve 122 is open to allow the free flow of sea water into the interior of the tank 100 and to the opposite side of the dual barrier bladder 104. FIG. 1A shows a cross section of the tank 100 independent of the overall potential size of the tank 100. This configuration can be applied to tanks of relatively small volumes of several hundred gallons to tanks sized well over thousands of gallons. The defining quality of the geometry of the tank 100 is that the tank 100 is comprised of split halves, a first shell half 130, which is flanged and bolted to a second shell half 132, which creates a flange 134 to seal the edges of the dual barrier bladder 104, which is fastened together with bolts 138. Each shell half 130 and 132 is constructed as a dual wall shell, so that in each shell half 130 and 132 a fluid can be placed in a space 140 between the inner tank shell 103 and an outer tank shell 101, and can be sealed and controlled.

Figure 2:
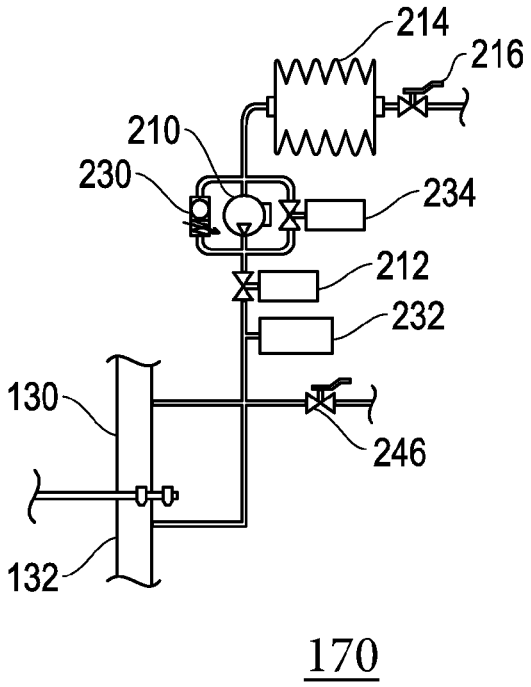
FIG. 2 is a schematic diagram showing equipment used to test the dual shells of the tank.

The first shell half 130 and the second shell half 132 are tested by a tank shell test package 170, through a tubing conduit connection drawing on the fluid in the space 140. The shell test package 170 is shown in FIG. 2. This testing can be accomplished when the tank 100 is on the surface, or below sea water, and at any time. The dual barrier bladder 104 is tested by a dual barrier bladder test package 172, shown in FIG. 3. This testing can be accomplished when the tank 100 is on the surface or below sea water, and at any time, and can be accomplished concurrently with testing either shell half 130 or 132.

Filling operations of the tank require that the fill valve 114 be opened, so that bulk fluid can then be pumped into the tank 100. The discharge valve 120 may be open or closed, and the tank 100 can be discharging or not discharging during the fill operation. The tank 100 can be filled before deployment subsea, and can be filled while deployed subsea during operation or when idle.

Measurement of the tank 100 levels for volumes of either the bulk fluid, or of compensating sea water, is performed by tracking and comparing the amount of either fluid as it enters or exits the tank 100. A flow meter 156 for the sea water compensation measures the amount of sea water that enters and exits the tank 100. A fill flow meter 162 measures the amount of bulk fluid that enters the tank 100. A discharge flow meter 164 measures the amount of bulk fluid that is discharged from the tank 100. A control method is established that compares the amount of fluid that passes each of these meters 156, 162, and 164. This amount is always compared so that it is understood to very exact amounts how much bulk fluid, or sea water, is in the tank 100. If for any reason the tank 100 is completely emptied or completely filled, the tank empty limit switch 118 or the tank full limit switch 112 will signal the control system to stop discharge, stop fill, or close the discharge valve 120, the fill valve 114, or the sea water compensation valve 122.

The fill valve 114, the discharge valve 120, and the safety valve 146 are necessary to ensure that the storage tank 100 cannot be compromised should a malfunction of a control system (not shown) occur. The safety valve 146 for the discharge fill piping 148 will open should the storage tank 100 become over-pressured. The compensation valve 122 is also a safety valve in that it is normally open, and the control system is required to shut it in any necessary operation. A pressure transducer 174 measures internal tank pressure, and differential pressure between the inside and outside of the storage tank 100. When the pressure transducer 174 signals that an overpressure or under pressure condition is detected of a certain value, the fill valve 114 and the discharge valve 120 can be automatically closed.

On the top and bottom of the storage tank 100 are two access ports 176 and 178. The access port 176 has a piston 110, and the access port 178 has a piston 116. The pistons 110 and 116 will translate when the dual barrier bladder 104 presses from the inside against the pistons 110 and 116. The pressure by the dual barrier bladder 104 pushes the pistons 110 and 116 against limit switches 112 and 118, thus signaling the position of the dual barrier bladder 104. The limit switch 112 signals that the storage tank 100 is full of bulk fluid. When the limit switch 118 signals, then the storage tank 104 is empty of bulk fluid. Included in the access port 176 is a vent and drain valve 180. The vent and drain valve 180 is used for releasing trapped air in the assembled storage tank 104. The vent and drain valve 180 is also used for releasing trapped air in the first shell half 130 and in the second shell half 132, or for draining fluid from either the first shell half 130 or from the second shell half 132. When differential pressure is detected by the pressure transducer 174 of a certain value, the fill valve 114 and the discharge valve 120 can be automatically closed.

A fine sea water filter 182 and a coarse marine life excluder 184 are used together to keep debris and marine life from entering the tank. A vent valve 188 is located at the top of the tank 100 and the first shell half 130 to allow air to be vented when filling the space 140.

Figure 1B:
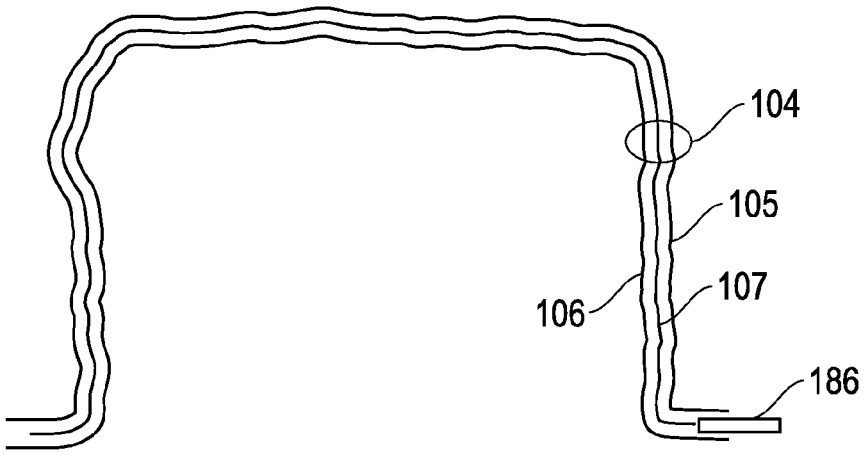
FIG. 1B is a cross section of the dual barrier bladder showing the first barrier wall, second barrier wall, the porous mesh between the walls, and the fluid access port.

FIG. 1B shows a first barrier bladder wall 105, a second barrier bladder wall 106, and a porous mesh membrane 107, which is located between the first barrier bladder wall 105 and the second barrier bladder wall 106, which together form the dual barrier bladder 104. Bonded between the walls 105, 106 is a tube access port 186 that allows fluid to enter from the dual barrier bladder test package 172 into a bladder inner space between the walls 105, 106 of the dual barrier bladder 104.

Figure 1C:
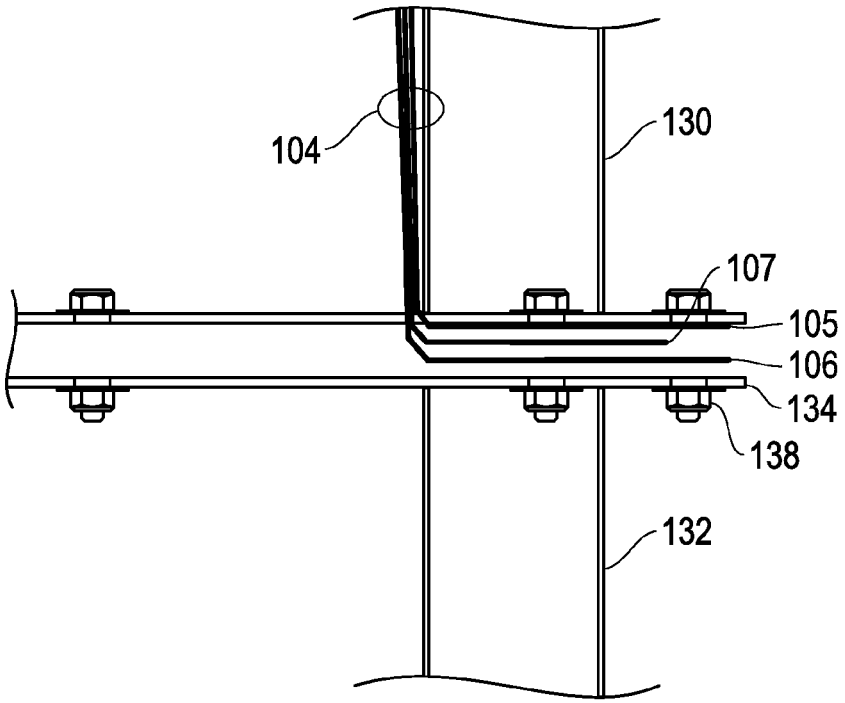
FIG. 1C is a schematic diagram showing a separation flange of the tank, the dual barrier bladder, and a porous mesh that is between the two barriers of the bladder.

FIG. 1C shows a view of the flange 134 of the storage tank 100, the dual barrier bladder 104, and the porous mesh membrane 107. The flange 134 is shown with a gap to illustrate the dual barrier bladder 104, the first barrier bladder wall 105, the second barrier bladder wall 106, and the porous mesh membrane 107, which is sealed by the flange 134. The bolts 138 are shown elongated only to illustrate the dual barrier bladder 104 and the porous mesh membrane 107. The porous mesh membrane 107 allows the free flow of lubricating oil or other fluid to flow and communicate throughout the entire inner space surfaces.

FIG. 2 shows the tank shell test package 170, which includes a pump 210, valves 212 and 216, a pressure transducer 232, a regulator valve 230, and a fluid storage compensator 214. The pump 210 can be configured to either pressurize or pull a vacuum on the first shell half 130 and the second shell half 132. The pump operation is controlled by an operator either at the storage tank 100 or remotely. When the pump 210 is operated, the valve 212 opens and allows fluid to flow from or into the fluid storage compensator 214. The fluid storage compensator 214 is sealed from the outside environment. The fluid storage compensator 214 can be filled or vented with the valve 216.

When the pump 210 is used for a test, it is operated for a specific amount of time until a designated pressure or vacuum is reached. This test pressure or vacuum is regulated by a regulator valve 230, that can be either locally adjusted or remotely adjusted, and remotely controlled. The test pressure or vacuum is measured by a pressure transducer 232. Once desired pressure or vacuum is achieved, the valve 212 is closed, trapping the pressure or vacuum to be recorded and viewed for a defined amount of time. Upon completion of the test, both the valve 212, and a valve 234, are opened to allow fluid to flow from the fluid storage compensator 214 to equalize the fluid pressure. A valve 246 is used to fill the first shell half 130 and the second shell half 132 with fluid.

Figure 3:
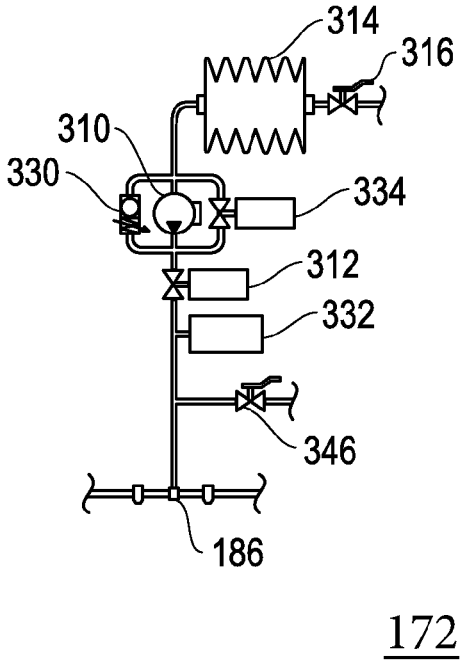
FIG. 3 is a schematic diagram showing equipment used to test the dual barrier bladder inside the tank.

FIG. 3 shows the dual barrier bladder test package 172, which includes a dual barrier bladder testing pump 310, valves 312, 316, 330, and 334, a pressure differential transducer 332, a regulator valve 330, and a fluid storage compensator 314. The pump 310 can be configured to either fill or pull a vacuum on the dual barrier bladder 104, via the access port 186 bonded into the perimeter seal of the dual barrier bladder 104. The access port 186 allows fluid to be placed between the walls of the dual barrier bladder 104, and then removed from between the walls of the dual barrier bladder 104. The pump 310 operation is controlled by an operator either at the storage tank 100 or remotely. When the pump 310 is operated, the valve 312 opens and allows fluid to flow from or into the fluid storage compensator 314. The fluid storage compensator 314 is sealed from the outside environment. The fluid storage compensator can be filled or vented with the valve 316. A valve 346 allows fluid to be added, drained, or vented from the dual barrier bladder 104. The valve 346 is used to test and flush the pump 310.

When the pump 310 is used for a test, it is operated for a specific amount of time until a designated vacuum is reached. This test vacuum is regulated by the valve 330, that can be either locally adjusted or remotely adjusted, and remotely controlled. The test vacuum is measured by a pressure differential transducer 332. Once desired vacuum is achieved, the valve 312 is closed, trapping the vacuum to be recorded and viewed for a derived amount of time. Upon completion of the test, both the valve 312, and the valve 334, are opened to allow fluid to flow from the fluid storage compensator 314 to equalize the fluid pressure. The dual bladder barrier 104 is configured in nearly two identical formed layers to the interior half of the storage tank 100 that are chemically resistant, impermeable coated fabric barriers.

What is claimed is:

1. A subsea storage tank for the storage of bulk fluids, the tank comprising:

an upper shell half and a lower shell half, the two halves being nearly identical halves, each half having a flange to bolt and assemble the halves into a complete tank;

into and between the flanged halves of the tank, a first barrier bladder isolates and prevent comingling of a storage fluid in one half of the tank from the other half of the tank;

an identical tandem barrier bladder is positioned so that the two barrier bladders to act together, and so that the space between them can contain fluid as well, and an inner shell and an outer shell, the shells adapted for receiving a barrier fluid between the shells.

2. The subsea storage tank according to claim 1, further comprising a pump and associated automatic valves so that the shells, and the barrier bladders, can be pressurized or vacuum drawn down to test the integrity of either the shells or the barrier bladders.

3. The subsea storage tank according to claim 2, further comprising adaptations and connections for lowering the tank subsea either full or empty of bulk fluid, and for fitting to a temporary or permanent subsea structure, by hoses, pipes, or hydraulic couplings.

4. The subsea storage tank according to claim 3, further comprising access ports with pistons, wherein the pistons move in response to pressure from the barrier bladders to close the access ports, thus stopping the entry of fluid into the tank.

* * * * *